US006845815B2

(12) United States Patent
Hergarden et al.

(10) Patent No.: US 6,845,815 B2
(45) Date of Patent: Jan. 25, 2005

(54) TEMPORARY ABANDONMENT CAP

(75) Inventors: Thomas Hergarden, Houston, TX (US); Richard Murphy, Humble, TX (US); Paul Riley, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 40 days.

(21) Appl. No.: 10/228,737

(22) Filed: Aug. 27, 2002

(65) Prior Publication Data

US 2004/0040702 A1 Mar. 4, 2004

(51) Int. Cl.[7] ..... E21B 33/02
(52) U.S. Cl. ..... 166/92.1; 166/75.13
(58) Field of Search ..... 166/75.13, 92.1, 166/351, 356, 360, 365, 368

(56) References Cited

U.S. PATENT DOCUMENTS

| | | | | |
|---|---|---|---|---|
| 4,405,016 A | | 9/1983 | Best | 166/337 |
| 4,423,983 A | | 1/1984 | Dadiras et al. | 405/195 |
| 4,544,036 A | | 10/1985 | Saliger | 166/341 |
| 4,881,597 A | * | 11/1989 | Hensley | 166/92.1 |
| 5,107,931 A | | 4/1992 | Valka et al. | 166/342 |
| 5,992,526 A | | 11/1999 | Cunningham et al. | 166/343 |
| 6,494,257 B2 | * | 12/2002 | Bartlett et al. | 166/86.2 |
| 6,494,266 B2 | * | 12/2002 | Rogala et al. | 166/339 |
| 2002/0000322 A1 | | 1/2002 | Bartlett et al. | 166/368 |
| 2002/0088622 A1 | | 7/2002 | Beall et al. | 166/342 |

FOREIGN PATENT DOCUMENTS

| | | | |
|---|---|---|---|
| GB | 2 330 160 A | 4/1999 | E21B/33/04 |
| WO | WO 95/16102 | 6/1995 | E21B/29/12 |
| WO | WO 99/28593 | 6/1999 | E21B/33/037 |

OTHER PUBLICATIONS

International Search report (PCT/US03/01446), May 2003.

* cited by examiner

*Primary Examiner*—Zakiya Walker
(74) *Attorney, Agent, or Firm*—Williams, Morgan & Amerson, P.C.

(57) ABSTRACT

A temporary abandonment cap includes a body, a pressure-retaining top portion extending across the body and a plurality of locking pins coupled to the body and a single moveable handle, the locking pins being adapted to be moved from an engaged position to a disengaged position by movement of the single handle. The temporary abandonment cap is lightweight, reusable, and can be placed on and retrieved from an open pipe of a subsea well.

29 Claims, 7 Drawing Sheets

TEMPORARY ABANDONMENT CAP

BACKGROUND OF THE INVENTION

1. Field of the Invention

The present invention is generally directed to the field of offshore well drilling, and, more particularly, to a lightweight, reusable temporary abandonment cap that can be placed on and retrieved from an open pipe of a subsea well.

2. Description of the Related Art

Drilling of offshore oil and gas wells is a very expensive and time-consuming activity. Moreover, when drilling and/or completing such wells, there may be many occasions, both planned and unexpected, where it is desirable to temporarily suspend drilling or completion activities at a well. As part of this process, a temporary abandonment cap is installed to aid in protecting the wellhead during this period of inactivity. Typically, a portion of the well bore will be filled with a liquid corrosion inhibitor to displace the seawater within the bore such that certain surfaces, e.g., sealing surfaces, are not corroded by the seawater or otherwise subjected to the formation of undesirable marine growth, e.g., algae. The temporary cap is used in an effort to keep the corrosion inhibitor fluid in the bore until such time as it is desired to resume drilling and/or completion activities at the well.

Some prior art temporary caps were locked to the wellhead by a plurality of sacrificial pins. See, for example, U.S. Pat. No. 5,107,931 (Valka et al.) for an example of such a temporary cap. Some prior art temporary abandonment caps were comprised of a relatively heavy steel body and they were deployed from a surface vessel or rig via a drill string. The cap 12 depicted in FIG. 4 of the Valka patent weighed approximately 600 pounds. A running and retrieve tool 42 was attached to the end of a drill string and the running and retrieve tool 42 included a plurality of pins 48 for holding the temporary cap 12 during transit to the well. In this position, the temporary abandonment cap 12 was secured to the well by a plurality of spring-loaded, sacrificial pins 32. An upward force was exerted on the drill string once the cap 12 was properly positioned over the wellhead to shear the pins 48. To remove the cap 12, the running and retrieve tool 42 was run from the surface to the temporary cap 12 and coupled to the cap 12 by spring-loaded pins 50. Thereafter, an upward force was exerted by the drill string to shear the sacrificial pins 32 to thereby release the temporary cap 12 from engagement with the wellhead.

FIGS. 1A–1C are various views of an illustrative prior art running and retrieve tool 10 for use with the temporary abandonment cap 12 depicted in the Valka patent. FIGS. 1A and 1B are, respectively, side and plan views of the tool 10. The running and retrieve tool 10 is generally comprised of a body 11 having a conical portion 13 that defines an opening 14. A threaded connection 11A is provided to secure the tool 10 to a drill string. The tool 10 further comprises a plurality of ROV (remotely operated vehicle) handle assemblies 15. Each of the handle assemblies 15 is comprised of a gripper block 15A, a rod 17, a housing 18, and a set screw 16. FIG. 1C is an enlarged view of a helical groove 19 formed in each of the rods 17. The running and retrieve tool 10 is generally comprised of various carbon steel materials, and it has an approximate weight of 100–150 pounds.

In operation, to run the temporary cap 12 down to the well, the tool 10 is secured to the temporary cap 12 of the Valka patent by positioning the stem 22 (see FIG. 4 of the Valka patent) in the opening 14 in the running and retrieve tool 10. The ROV handles 15 are then manually rotated in a clockwise direction to advance the ends 17A of the rods 17 into the grooves 28 of the stem 22 shown in FIG. 4 of the Valka patent. The rods 17 are advanced by virtue of the camming action achieved as the helical groove 19 in the rod 17 engages the set screw 16. The combined assembly of the running and retrieve tool 10 and the temporary cap 12 is then secured to the drill string via threaded connection 11A. Thereafter, the temporary cap 12 is run down to the well and coupled thereto by the techniques described in the Valka patent. An ROV is then used to rotate the handles 15 on the tool 10 in a counter-clockwise direction to disengage the ends 17A of the rods 17 from the groove 28 in the stem 22 of the temporary cap 12. The running and retrieve tool 10 is then retrieved to the surface. To remove the temporary cap 12, the tool 10 is secured to the drill string and run down to the wellhead. Using the conical opening 14, the tool 10 is maneuvered until such time as the stem 22 of the temporary cap 12 is positioned in the tool 10. An ROV is then used to rotate the handles 15 in a clockwise direction such that the ends 17A of the rods 17 engage the groove 28 on the stem 22. A pulling force is then generated to shear the pins 32, thereby releasing the temporary cap 12 from the well.

In other cases, the running and retrieve tool 10 shown in FIGS. 1A–1C may be used to deploy the temporary cap 12 by means of an ROV. In that case, a sub (not shown) is threadingly coupled to the tool 10 via the threaded connection 11A. The sub may be used to provide a means to inject fluid into the well via a hot stab manifold. A shackle (not shown) is secured to the top of the sub. A cable is connected to the shackle and the combination of the tool 10 and the temporary cap 12 is lowered into the sea until such time as an ROV can grasp the assembly and position it on the wellhead. After the cap 12 is secured to the wellhead by the sacrificial pins 32, the ROV rotates the handles 15 such that the rod ends 17A are in their retracted position, and the retrieve tool 10 may be removed leaving the cap 12 on the well.

FIG. 2 is a cross-sectional view of an alternative temporary abandonment cap 20 that employs a plurality of ROV-operated handles 15 for locking and unlocking the temporary cap 20 to and from the wellhead. In FIG. 2, the same references numbers will be used to describe parts that function in a similar manner to those described previously in connection with FIGS. 1A–1C. The temporary cap 20 is generally comprised of a cylindrical body 21, a conical portion 23, a top portion 25, a stem 22A and a groove 28A. The cap 20 further comprises a plurality of check valves 27A, 27B positioned on the top portion 25 of the cap 20. The cap 20 is generally made from carbon steel material, and its weight is approximately 600 pounds. A running and retrieve tool (not shown) may be used to position the cap 20 over the well (not shown). Thereafter, an ROV is used to rotate the handle 15A such that the end portions 17A of the rod 17 engages a recess or groove in the well. To remove the cap 20, the running and retrieve tool is landed on the stem 22A, and an ROV is used to rotate the handles 15A on the cap 20 such that the ends 17A of the rods 17 are disengaged from the well. The cap 20 may then be retrieved to the surface.

U.S. patent application Ser. No. 2002/0000322A1 (Bartlett et al., Jan. 3, 2002) depicts a situation in which a debris cap 460 is used in conjunction with an internal tree cap 458. See, e.g., FIGS. 13, 16 and 17 and the associated discussion thereof The debris cap performs a variety of functions. For example, the debris cap 460 is used to protect various sealing surfaces on the exposed end of the Christmas tree. The debris cap 460 also serves to prevent debris from collecting in the annular area between the internal tree cap and the tree bore.

FIGS. 3A–3B are, respectively, plan and side views of an illustrative debris cap 30 that may be employed with an inner tree cap similar to that depicted in the Bartlett application. The debris cap 30 is comprised of a body 31, a conical portion 32, a top, circular portion 33, an O-ring seal 34 and an O-ring seal 35. The top, circular portion 33 of the debris cap 30 defines an opening 36 therein. The debris cap 30 is further comprised of two locking pins 37 that are coupled to a handle 38. A cam pin 39 is coupled to the locking pin 37 and it is adapted to move within the helical groove 40 formed in the housing 41 for the lock pins 37 when the handle 38 is raised or lowered. More specifically, in the position shown in FIGS. 3A and 3B, the ends 37A of the lock pins 37 are in a position to engage a groove on a wellhead (not shown). The O-ring seal 34 engages and seals against the outside diameter of the well. The O-ring 35 is adapted to seal against a tree cap that is to be subsequently installed. The handle 38 of the debris cap 30 may be operated by an ROV. With the handle 38 in the vertical position, the lock pins 37 are in their retracted, non-engaged position. In this position, the debris cap 30 may be positioned over the well by an ROV. Once properly positioned, the ROV may rotate the handle 38 to the position shown in FIGS. 3A–3B to thereby cause the lock pins 37 to move to their engaged position by virtue of the cam pins 39 moving within the groove 41 as the handle 38 is moved to its locked position. To remove the debris cap 30, the process is reversed.

Despite prior efforts, there still exists a need for temporary abandonment caps that may be readily deployed by means of an ROV. Moreover, such a temporary cap should provide means for supplying desired fluids to the well bore in a timely and efficient manner.

The present invention is directed to an apparatus for solving, or at least reducing the effects of, some or all of the aforementioned problems.

SUMMARY OF THE INVENTION

The present invention is directed to a lightweight, reusable temporary abandonment cap that can be placed on and retrieved from an open pipe of a subsea well. In one illustrative embodiment, the present invention is directed to a well cap comprised of a body, a pressure-retaining top portion extending across the body, and a plurality of locking pins coupled to the body and a single moveable handle, the plurality of locking pins adapted to be moved from an engaged position to a disengaged position by movement of the single moveable handle.

In another illustrative embodiment, the well cap is comprised of a body, a pressure-retaining top portion extending across the body, a plurality of locking pins coupled to the body and a single moveable handle, wherein the plurality of locking pins are adapted to be moved from an engaged to a disengaged position by movement of the single moveable handle. The well cap further comprises a plurality of check valves coupled to the top portion of the cap and a hot stab manifold coupled to the top portion of the cap, wherein the hot stab manifold is coupled to at least one of the valves such that a fluid may be introduced into a well via the hot stab manifold and the valve, and a conical portion coupled to the body at an end opposite the top portion.

In yet another illustrative embodiment, the well cap is comprised of a body, a pressure-retaining top portion extending across the body, a plurality of locking pins coupled to the body and a single moveable handle, the plurality of locking pins adapted to be moved from an engaged to a disengaged position by movement of the single moveable handle. The cap is further comprised of a plurality of check valves coupled to the top portion, a hot stab manifold releasably coupled to the top portion, wherein the hot stab manifold is coupled to at least one of the valves such that a fluid may be introduced into a well via the hot stab manifold and the valve, and a pipe extension in fluid communication with one of the check valves, wherein the pipe extension has an open end that is positioned below the top portion.

BRIEF DESCRIPTION OF THE DRAWINGS

The invention may be understood by reference to the following description taken in conjunction with the accompanying drawings, in which like reference numerals identify like elements, and in which.

Figure 1A:
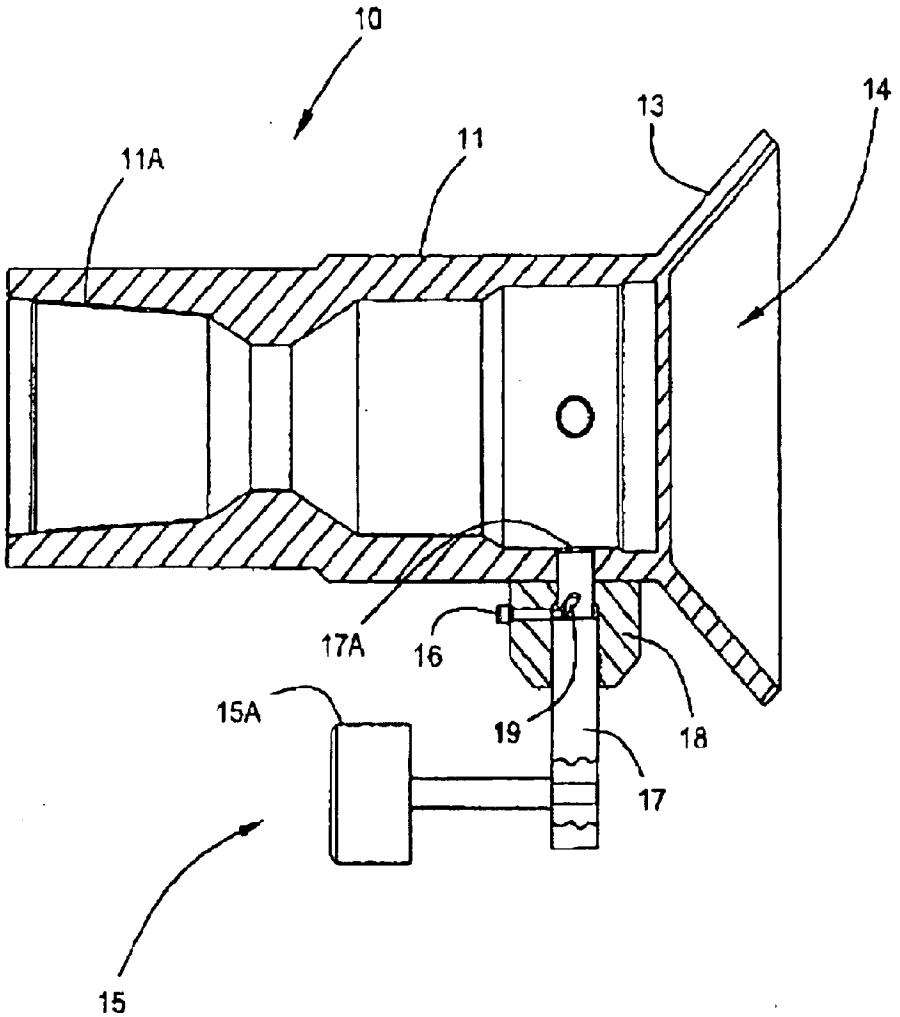
FIG. 1A (PRIOR ART)
FIGS. 1A–1C are various views of an illustrative prior art running and retrieve tool for a temporary abandonment cap.
Figure 1C:
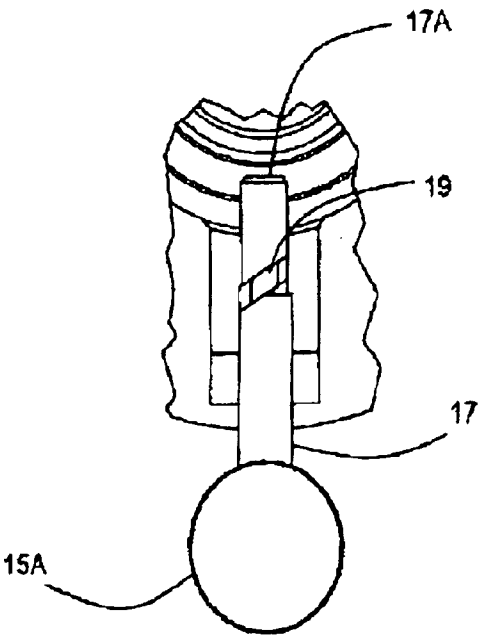
FIG. 1C (PRIOR ART)
Figure 1B:
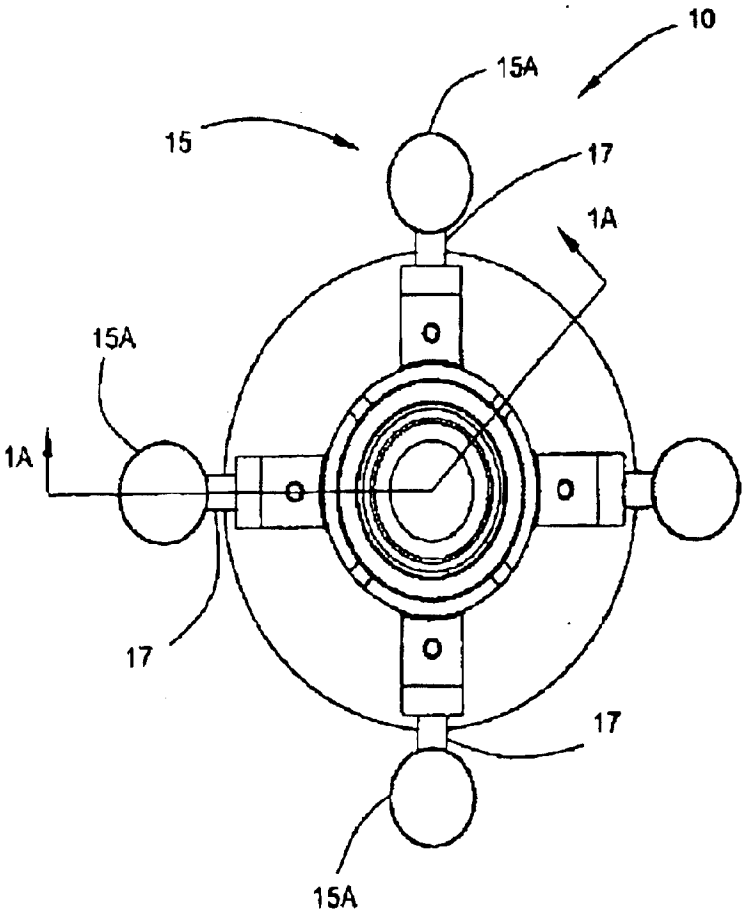
FIG. 1B (PRIOR ART)
Figure 2:
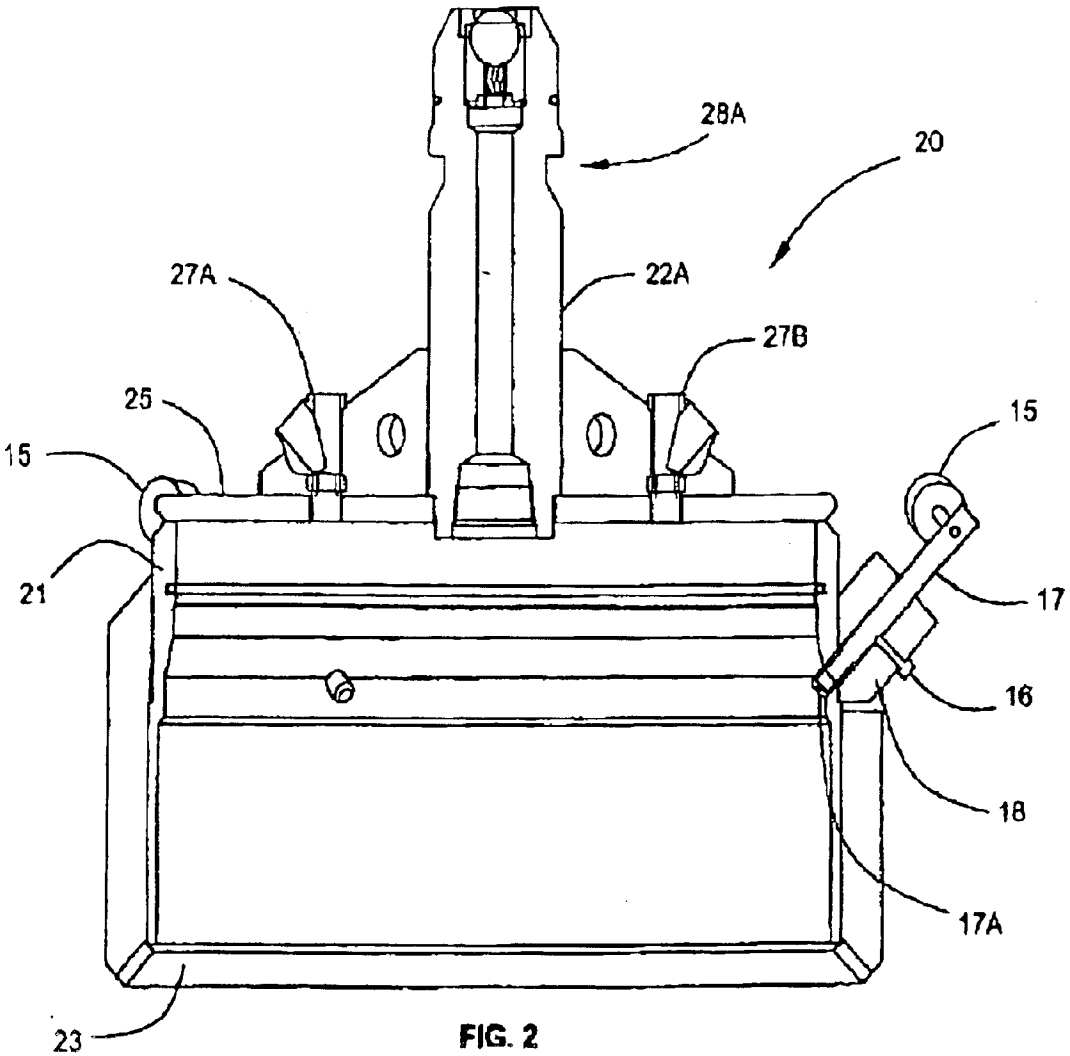
FIG. 2 (PRIOR ART)
FIG. 2 is a plan view of an illustrative prior art temporary abandonment cap.
Figure 3A:
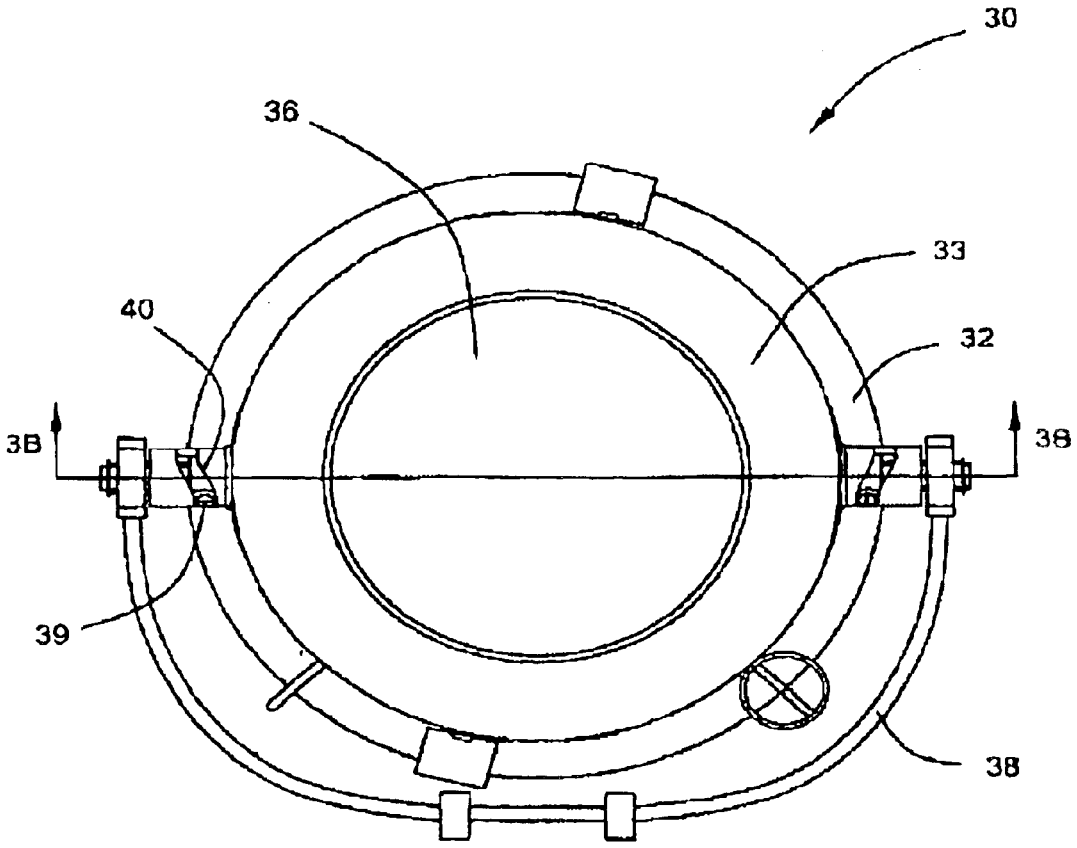
FIG. 3A (PRIOR ART)
FIGS. 3A–3B are various views of an illustrative prior art debris cap.
Figure 3B:
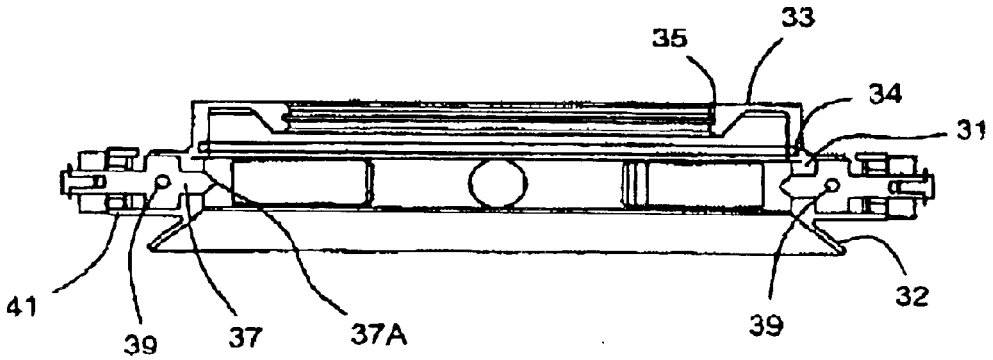
FIG. 3B (PRIOR ART)

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 4A:
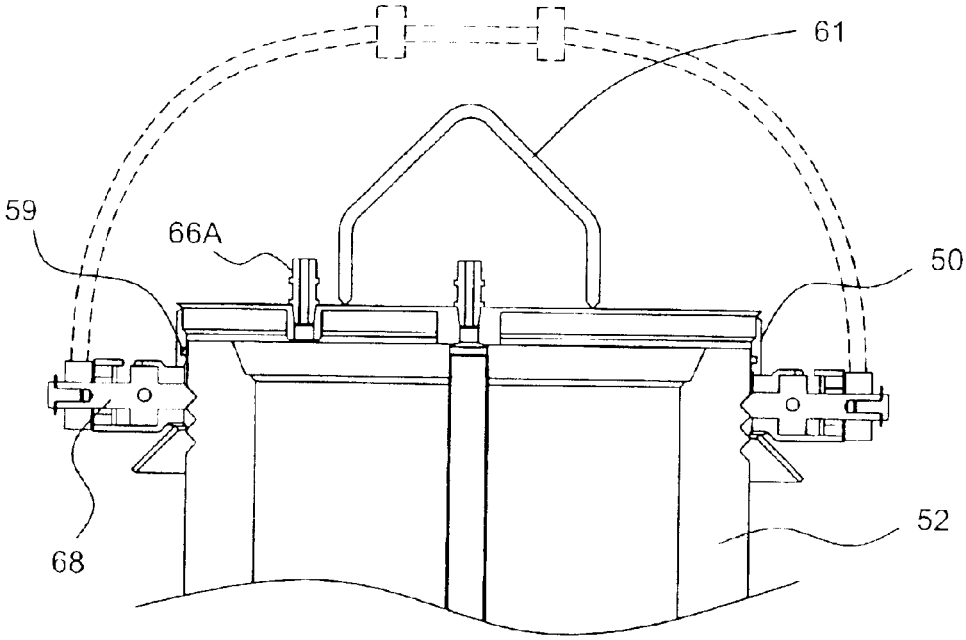
FIGS. 4A–4D are various views depicting one illustrative embodiment of the present invention.
Figure 4B:
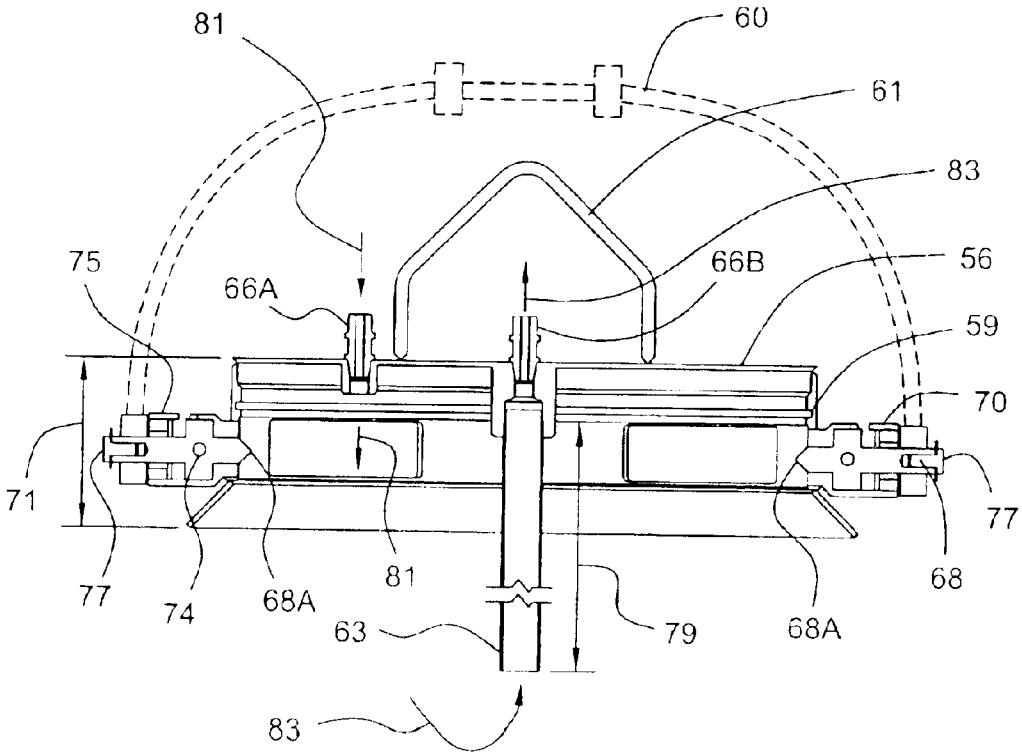
Figure 4C:
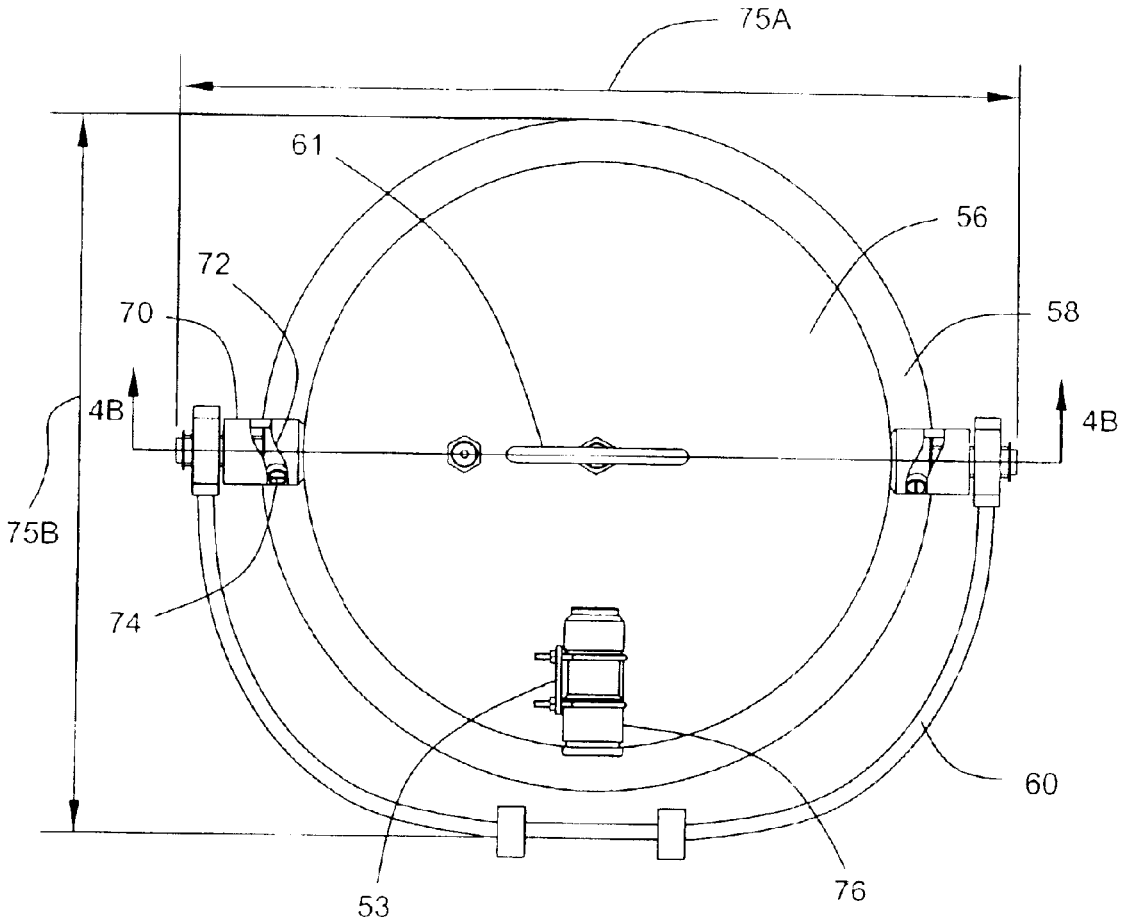
Figure 4D:
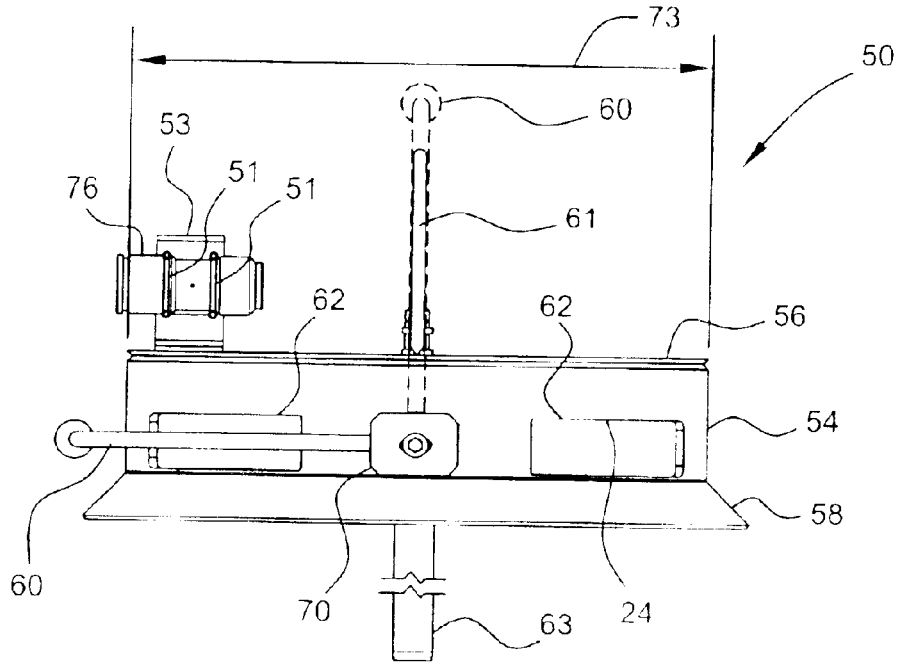

FIGS. 4A–4D are various views of a temporary abandonment cap 50 in accordance with one illustrative embodiment. As shown in FIG. 4A, the cap 50 is engaged with a wellhead 52. As shown in FIG. 4D, the cap 50 is comprised of a cylindrical body 54, a top portion 56, a funnel portion 58, a movable handle 60, and a fixed handle 61. An O-ring seal 59 (see FIG. 4B) is provided such that the cap 50 may be sealingly engaged to the outside diameter of the wellhead 52. A plurality of cutouts 62 are made in the body 54 to reduce the weight of the cap 50. The cap 50 may weigh approximately 150 pounds. The cap 50 further comprises a plurality of check valves 66A, 66B, and a pipe extension 63 coupled to the check valve 66B.

The cap 50 further comprises two lock pins 68 that are operatively coupled to the movable handle 60. The lock pins 68 are positioned within a housing 70 having a groove 72 (see FIG. 4C) formed therein. A retaining nut 75 is used to secure the lock pin 68 within the housing 70. The moveable handle 60 is secured to the lock pins 68 by bolts 77 that are threadingly engaged with the lock pin 68. A cam pin 74 is fixedly coupled to the lock pins 68, and the cam pin 74 is adapted to move within the groove 72 when the movable handle 60 is actuated. A hot stab manifold assembly 76 is also secured to the cap 50 by a plurality of U-bolts 51 that are coupled to a bracket 53.

The components of the cap 50 are generally comprised of carbon steel. For example, the cylindrical body 54 and the conical portion are comprised of ⅜" or ½" plate steel rolled, welded and cut to the desired size. The top portion 56 may be comprised of approximately ⅛"–3⁄16" steel plate. The temporary cap 20 is not exposed to well pressures, thus the top portion 56 may be relatively thin. In operation, a differential pressure of less than approximately 0.33 psi will be applied across the top portion 56. This differential pressure is due to the presence of the lighter, anti-corrosive fluid in the well bore. The movable handle 60 and the fixed handle 61 may be made of ¾" bar stock material that is formed as desired. The physical size of the temporary cap 50 may vary depending upon the application. In one embodiment, the body of the cap 50 has a height 71 of approximately 8 inches, a diameter 73 of approximately 27.4 inches and an overall footprint as defined by a first dimension 75A of approximately 37.5 inches and a second dimension 75B of approximately 32.5 inches.

The size, shape and configuration of the openings 62 may vary. The purpose of the openings 62 is to reduce the overall weight of the cap 50 such that ROV deployment and retrieval may be easier. Thus, the particular size, shape and configuration of the openings 62 should not be considered a limitation of the present invention unless such limitations are expressly set forth in the appended claims. Moreover, the relative location of the valves 66A, 66B and the hot stab manifold assembly 76 may be varied depending upon the application. The hot stab manifold assembly 76 may be hard plumbed to, for example, the check valve 66A, although that is not depicted in the attached figures. The length 79 (see FIG. 4B) of the pipe extension 63 may also vary from, for example, approximately 0–70 inches. In one illustrative embodiment, the pipe extension 63 has a length 79 that extends approximately 44" inches below the sealing surface defined by the O-ring seal 59.

In FIGS. 4C and 4D, the moveable handle 60 is depicted (in solid lines) in its closed or locked position. With the moveable handle 60 in the closed position, the lock pins 68 are in their extended or engaged position such that the ends 68A of the lock pins 68 may engage a recess formed in the wellhead 52. The camming groove 72 is sized and configured such that the travel of the cam pin 74 is limited which, in turn, limits the travel of the moveable handle 60 to an extended, or open, position as depicted by dashed lines in FIGS. 4A, 4B and 4D. In this extended position, i.e., in the most upright position, the moveable handle 60 will be positioned approximately directly above the fixed handle 61. Moreover, the moveable handle 60 is designed such that, all other things being equal, the moveable handle 60 will tend to return to its closed position indicated by the solid lines in FIGS. 4A–4D. This handle bias may be established by appropriate weightings. Additionally, when the moveable handle 60 is in its most upright position, the weight is distributed on the cap 50 such that it will tend to tilt in a known direction. In the depicted embodiment, when the moveable handle 60 is in its upright position, the cap 50 will tend to tilt in the direction of the hot stab manifold 76. This aspect assists in making the unit more stable when the moveable handle 60 is in its most upright position.

In operation, the cap 50 may be lowered into the water by means of a cable (not shown) attached to the fixed handle 61 or the moveable handle 60 when it is in its upright position. The cap 50 is lowered until such time as an ROV is able to grasp the moveable handle 60 (in its upright position) and transport the cap 50 to the wellhead. The movable handle 60 is in its upright position (not shown) prior to being positioned on the well. With the movable handle 60 in the upright position, the lock pins 68 are in their retracted, non-extended, non-engaged position by virtue of the camming action resulting from the cam pins 74 moving within the grooves 72 when the movable handle 60 was raised to its upright position. The shape and configuration of the moveable handle 60 is such that it can accommodate the linear travel of the lock pins 68 associated with this camming action. The conical portion 58 of the cap 50 is used to assist in the positioning of the cap 50 over the wellhead. Once the temporary cap 50 is properly positioned on the well, the ROV may be used to move the movable handle 60 to the closed or locked position shown in FIGS. 4A–4D. In this closed or locked position, the ends 68A of the lock pins 68 are in their extended, engaged position by virtue of the camming action associated with the movement of the cam pins 74 within the groove 72 as the moveable handle 60 is rotated to its closed position. That is, the end 68A of the lock pins 68 are moved to a position whereby they are positioned within a recess or groove in the well, thereby securing the temporary cap 12 to the well.

Once the temporary cap 50 is properly seated and locked on the well, the next operation involves injecting an anti-corrosion fluid into the well through the connections provided on the cap 50. More specifically, an injection probe of the ROV is mated with the hot stab manifold assembly 76 to allow injection of a quantity of the anti-corrosive fluid on board the ROV to be injected into the well. As mentioned previously, in one illustrative example, the hot stab manifold assembly 76 is hard plumbed to the check valve 66A. The anti-corrosive fluid is injected into the well via the hot stab manifold 76 and the check valve 66A, as indicated by the arrows 81 (see FIG. 4B). Since the anti-corrosive fluid is typically lighter than sea water, the injected fluid will tend to collect immediately under the cap 50. As more of the anti-corrosive fluid is injected, the sea water in the well is ejected out of the well via the pipe extension 63 and the check valve 66B, as indicated by the arrows 83. This process is continued until such time as substantially all of the sea water within the well for a depth corresponding to the length 79 of the pipe extension 63 is displaced by the anti-corrosive fluid. That is, the process may be continued until such time as the anti-corrosive fluid is observed exiting the well via the check valve 66B.

The length 79 of the pipe extension 63 is based upon the desired amount of coverage of the anti-corrosive fluid within the well. This is normally determined by the depth of the surfaces within the well that are desired to be protected. Moreover, it should be understood that the fluid injected into the well may be of any type. For example, in lieu of, or in addition to, the anti-corrosive fluid, a fluid may be injected for purposes of reducing marine growth on certain surfaces within the well.

To remove the cap 50, an ROV is used to grasp and move the moveable handle 60 from its closed position, shown in FIGS. 4A–4D to its upright position, shown by the dashed lines in FIGS. 4B and 4D, wherein the lock pins 68 are disengaged from the recess in the well. The ROV may then grasp either the moveable handle 60 or the fixed handle 61 while retrieving the cap 50.

Figure 5:
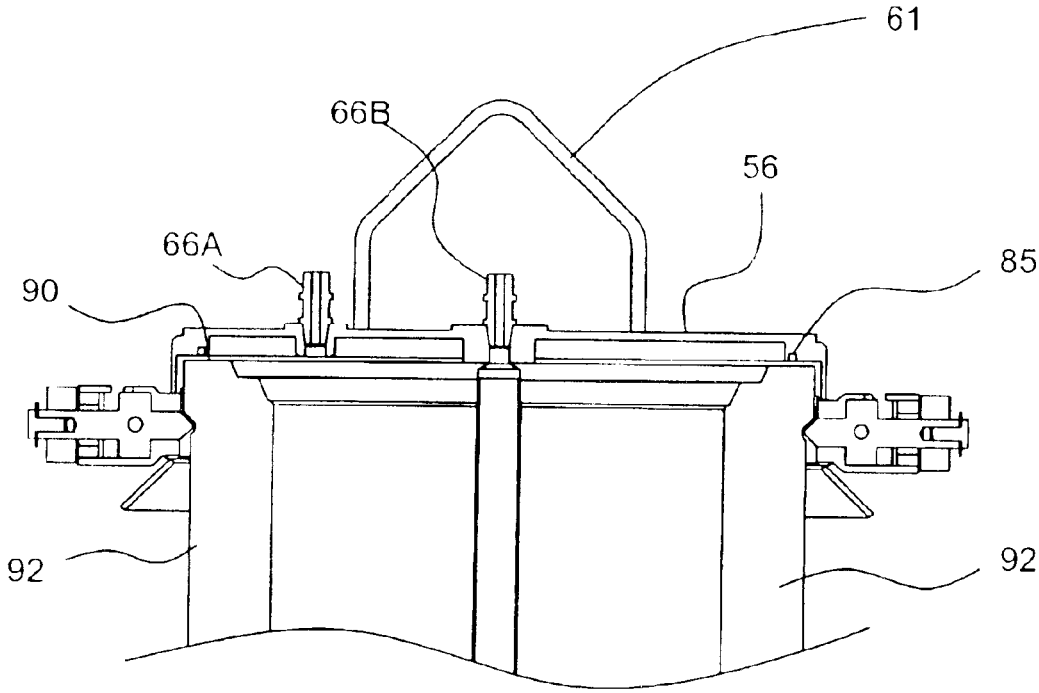
FIG. 5 is a cross-sectional view of yet another illustrative embodiment of the present invention.

The embodiments of the cap 50 depicted in FIGS. 4A–4D are adapted for use with a so-called H-4 wellhead in which the O-ring seal 59 is adapted to sealingly engage a portion of the outer diameter of the wellhead 52. FIG. 5 depicts an alternative embodiment of the cap 50 that is adapted for use with a so-called clamp-type wellhead. In this embodiment, an O-ring seal 85 positioned in the top portion 56 is adapted to sealingly engage a top surface 90 of the wellhead 92. The physical dimensions of the cap 50 depicted in FIG. 5 are somewhat larger than that of the cap 50 depicted in FIGS. 4A–4D. For example, it may have an outer diameter of approximately 32.5 inches and an overall height of approximately 9 inches.

The present invention is generally directed to a temporary well abandonment cap. In one illustrative embodiment, the present invention is directed to a well cap comprised of a body, a pressure-retaining top portion extending across the body, and a plurality of locking pins coupled to the body and a single moveable handle, the plurality of locking pins adapted to be moved from an engaged position to a disengaged position by movement of the single moveable handle.

In another illustrative embodiment, the well cap is comprised of a body, a pressure-retaining top portion extending across the body, a plurality of locking pins rotatably coupled to the body and fixedly coupled to a single moveable handle, wherein the plurality of locking pins can be moved from an engaged to a disengaged position by movement of the single moveable handle. The well cap further comprises a plurality of check valves and a hot stab manifold coupled to the top portion, the hot stab manifold being coupled to at least one of the valves such that a fluid may be introduced into a well via the hot stab manifold and the valve, and a conical portion coupled to the body at an end opposite the top portion.

In yet another illustrative embodiment, the well cap is comprised of a body, a pressure-retaining top portion extending across the body, a plurality of locking pins coupled to the body and a single moveable handle, wherein the plurality of locking pins can be moved from an engaged to a disengaged position by movement of the single moveable handle. In this embodiment, the cap further comprises a plurality of check valves coupled to the top portion and a hot stab manifold releasably coupled to the top portion, the hot stab manifold being coupled to at least one of the valves such that a fluid may be introduced into a well via the hot stab manifold and the valve, a pipe extension in fluid communication with one of the check valves, the pipe extension having an open end that is positioned below the top portion, and a conical portion coupled to the body at an end opposite the top portion.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A well cap, comprising:

a body;

a pressure-retaining top portion extending across said body; and a plurality of locking pins coupled to said body and a single moveable handle, said plurality of locking pins adapted to be moved from an engaged position to a disengaged position by movement of said single moveable handle.

2. The well cap of claim 1, further comprising a conical portion coupled to said body at an end opposite said top portion.

3. The well cap of claim 1, further comprising a hot stab manifold coupled to said top portion.

4. The well cap of claim 3, wherein said hot stab manifold is releasably coupled to a bracket that is fixedly coupled to said top portion.

5. The well cap of claim 1, further comprising a plurality of check valves coupled to said top portion and a hot stab manifold coupled to said top portion, said hot stab manifold being coupled to at least one of said valves such that a fluid may be introduced into a well via said hot stab manifold and said at least one valve.

6. The well cap of claim 1, further comprising a plurality of check valves operatively coupled to said top portion and a pipe extension in fluid communication with one of said check valves, said pipe extension having an end that is positioned below said top portion.

7. The well cap of claim 6, wherein said end of said pipe extension extends beneath said top portion by a distance that ranges from approximately 1–70 inches.

8. The well cap of claim 1, further comprising a plurality of openings formed in said body.

9. The well cap of claim 1, further comprising an O-ring seal positioned in said body, said O-ring seal adapted to sealingly engage a portion of an outer diameter of a wellhead.

10. The well cap of claim 1, further comprising an O-ring seal positioned in said top portion, said O-ring seal adapted to sealingly engage an end surface of a wellhead.

11. The well cap of claim 1, further comprising a cam pin coupled to each of said plurality of locking pins, said cam pin adapted to be positioned in a camming groove formed in a housing positioned around said locking pin.

12. The well cap of claim 1, further comprising a fixed handle coupled to said top portion.

13. A well cap, comprising:

a body;

a pressure-retaining top portion extending across said body;

a plurality of locking pins rotatably coupled to said body and fixedly coupled to a single moveable handle, said plurality of locking pins adapted to be moved from an engaged to a disengaged position by movement of said single moveable handle;

a plurality of check valves coupled to said top portion and a hot stab manifold coupled to said top portion, said hot stab manifold being coupled to at least one of said valves such that a fluid may be introduced into a well via said hot stab manifold and said at least one valve; and a conical portion coupled to said body at an end opposite said top portion.

14. The well cap of claim 13, wherein said hot stab manifold is releasably coupled to a bracket that is fixedly coupled to said top portion.

15. The well cap of claim 13, further comprising a pipe extension in fluid communication with one of said check valves, said pipe extension having an open end that is positioned below said top portion.

16. The well cap of claim 15, wherein said open end of said pipe extension extends beneath said top portion by a distance that ranges from approximately 1–70 inches.

17. The well cap of claim 15, further comprising a plurality of openings formed in said body.

18. The well cap of claim 13, further comprising an O-ring seal positioned in said body, said O-ring seal adapted to sealingly engage a portion of an outer diameter of a wellhead.

19. The well cap of claim 13, further comprising an O-ring seal positioned in said top portion, said O-ring seal adapted to sealingly engage an end surface of a wellhead.

20. The well cap of claim 13, further comprising a cam pin coupled to each of said plurality of locking pins, said cam pin adapted to be positioned in a camming groove formed in a housing positioned around said locking pin.

21. The well cap of claim 13, further comprising a fixed handled coupled to said top portion.

22. A well cap, comprising:

a body;

a pressure-retaining top portion extending across said body;

a plurality of locking pins coupled to said body and a single moveable handle, said plurality of locking pins adapted to be moved from an engaged to a disengaged position by movement of said single moveable handle;

a plurality of check valves coupled to said top portion and a hot stab manifold releasably coupled to said top portion, said hot stab manifold being coupled to at least one of said valves such that a fluid may be introduced into a well via said hot stab manifold and said at least one valve;

a pipe extension in fluid communication with one of said check valves, said pipe extension having an open end that is positioned below said top portion; and a conical portion coupled to said body at an end opposite said top portion.

23. The well cap of claim 22, wherein said hot stab manifold is releasably coupled to a bracket that is fixedly coupled to said top portion.

24. The well cap of claim 22, wherein said open end of said pipe extension extends beneath said top portion by a distance that ranges from approximately 1–70 inches.

25. The well cap of claim 22, further comprising a plurality of openings formed in said body.

26. The well cap of claim 22, further comprising an O-ring seal positioned in said body, said O-ring seal adapted to sealingly engage a portion of an outer diameter of a wellhead.

27. The well cap of claim 22, further comprising an O-ring seal positioned in said top portion, said O-ring seal adapted to sealingly engage an end surface of a wellhead.

28. The well cap of claim 22, further comprising a cam pin coupled to each of said plurality of locking pins, said cam pin adapted to be positioned in a camming groove formed in a housing positioned around said locking pin.

29. The well cap of claim 22, further comprising a fixed handled coupled to said top portion.

* * * * *